US006371600B1

(12) United States Patent
Murthy et al.

(10) Patent No.: US 6,371,600 B1
(45) Date of Patent: Apr. 16, 2002

(54) POLYMERIC NOZZLE PLATE

(75) Inventors: Ashok Murthy; James Harold Powers, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/097,341

(22) Filed: Jun. 15, 1998

(51) Int. Cl.[7] ..... B41J 2/05; B41J 2/14; B41J 2/15

(52) U.S. Cl. ..... 347/63; 347/47

(58) Field of Search ..... 347/56, 47, 63

(56) References Cited

U.S. PATENT DOCUMENTS

| | | | | |
|---|---|---|---|---|
| 4,007,464 A | | 2/1977 | Bassous et al. | |
| 4,409,602 A | | 10/1983 | Bolmgren et al. | |
| 4,716,423 A | | 12/1987 | Chan et al. | |
| 4,728,392 A | | 3/1988 | Miura et al. | |
| 4,733,823 A | | 3/1988 | Waggeneer et al. | |
| 4,791,436 A | | 12/1988 | Chan et al. | |
| 4,965,594 A | * | 10/1990 | Komuro | 347/62 |
| 5,167,776 A | | 12/1992 | Bhaskar et al. | |
| 5,237,148 A | | 8/1993 | Aoki et al. | |
| 5,305,015 A | | 4/1994 | Schantz et al. | |
| 5,350,616 A | | 9/1994 | Pan et al. | 428/131 |
| 5,378,137 A | | 1/1995 | Asakawa et al. | |
| 5,417,897 A | * | 5/1995 | Asakawa et al. | 264/22 |
| 5,548,894 A | | 8/1996 | Muto | 29/890.1 |
| 5,653,901 A | | 8/1997 | Yoshimura | |
| 5,653,901 C1 | | 8/1998 | Mills | |
| 5,790,151 A | * | 8/1998 | Mills | 347/47 |
| 5,907,333 A | * | 5/1999 | Patil et al. | 347/20 |
| 5,988,786 A | * | 11/1999 | Waller et al. | 347/20 |
| 6,010,208 A | * | 1/2000 | Powers et al. | 347/65 |
| 6,024,440 A | * | 2/2000 | Murthy et al. | 347/65 |

* cited by examiner

*Primary Examiner*—John Barlow
*Assistant Examiner*—Michael S. Brooke
(74) *Attorney, Agent, or Firm*—Frank Leach, Esq.

(57) ABSTRACT

A polymeric nozzle plate has a rectangular shaped passage extending through it with the passage converging to an orifice in one surface. A surface, which is parallel to the one surface, of the nozzle plate is adhered to a surface of a semiconductor substrate so that a rectangular shaped resistor on the surface of the semiconductor substrate is disposed within the large end of the passage. The walls of the passage are spaced substantially the same distance from the periphery of the resistor. The large end of the passage has at least one ink flow channel communicating therewith to supply ink, which is vaporized by heat from the resistor when an ink droplet is to be supplied through the orifice.

18 Claims, 1 Drawing Sheet

POLYMERIC NOZZLE PLATE

FIELD OF THE INVENTION

This invention relates to an ink jet nozzle plate of a thermal ink jet printer and, more particularly, an improved polymeric ink jet nozzle plate of a thermal ink jet printer.

BACKGROUND OF THE INVENTION

A major component of a print head of a thermal ink jet printer is a nozzle plate. The nozzle plate has a surface adhered to a surface of a semiconductor substrate on which are disposed numerous thin film heat resistors.

The nozzle plate has a plurality of bubble or firing chambers equal in number to the number of resistors on the semiconductor substrate. The resistors are disposed in the bubble or firing chambers.

Each of the bubble or firing chambers communicates with a separate ink supply channel. The separate ink supply channels communicate with a supply source of ink.

The nozzle plate also has passages, equal in number to the number of bubble or firing chambers. Each of the passages extends from one of the bubble or firing chambers through an orifice or port in a surface, which is parallel to the surface adhered to the semiconductor substrate. The droplets of ink are selectively expelled through the orifice or port for printing after the ink is selectively heated by the resistor.

One problem with the prior nozzle plates of thermal ink jet printers has been the accumulation of air bubbles in the bubble or firing chambers. The presence of an air bubble in the bubble or firing chamber can cause operational and print quality problems ranging in severity from moderately diminished jet velocity to severely anemic and misdirected jets of ink exiting through the orifices or ports of the nozzle plate.

It has been previously suggested to form a polymeric nozzle plate in which each of the bubble or firing chambers has the same configuration as the resistor on the semiconductor substrate and only slightly larger such as five microns, for example. While this minimizing of the dimensional differences between the walls of the bubble chamber and the periphery of the rectangular shaped resistor has reduced the size of any accumulated air bubble, air has continued to accumulate in the corners of the bubble or firing chamber where the rectangular shaped chamber meets a circular conical passage through which the ink is supplied to the orifice to be expelled as an ink droplet.

It has been discovered that decreasing the surface tension of the ink helps to reduce the adhesion force between any formed bubble and the wall of the bubble or firing chamber. The tension of the ink surface has been reduced by addition to the ink of surface active agents or low surface tension bulk additives. This reduction in the ink surface tension has permitted the air bubble to be more easily swept out of the passage under the action of jetting.

However, because of the surface active agent in the ink, the ink accumulates in puddles on the exterior surface of the nozzle plate having the orifice or port so that an emerging ink jet is pulled off center relative to the orifice or port through which it exits whereby the droplets of ink are deflected away from the intended spot on a recording medium. The additives also may adversely influence print head operation or print quality.

SUMMARY OF THE INVENTION

The nozzle plate of the present invention solves the problem of air accumulation in the bubble or firing chambers of a nozzle plate through eliminating geometric features that might trap the air. This is accomplished by changing the shape of each of the passages extending through the nozzle plate from a circular cone to a converging rectangular shape through the entire thickness of the nozzle plate.

Thus, with the resistor disposed in the largest end of the passage extending through the nozzle plate and the passage having a continuously converging rectangular shape until the orifice or port is reached, there is no intersecting surface on which the air bubbles can accumulate.

An object of this invention is to provide an improved nozzle plate for a print head of a thermal ink jet printer.

Other objects of this invention will be readily perceived from the following description, claims, and drawings.

BRIEF DESCRIPTION OF THE DRAWINGS

The attached drawings illustrate a preferred embodiment of the invention, in which.

DETAILED DESCRIPTION OF PREFERRED EMBODIMENT

Figure 1:
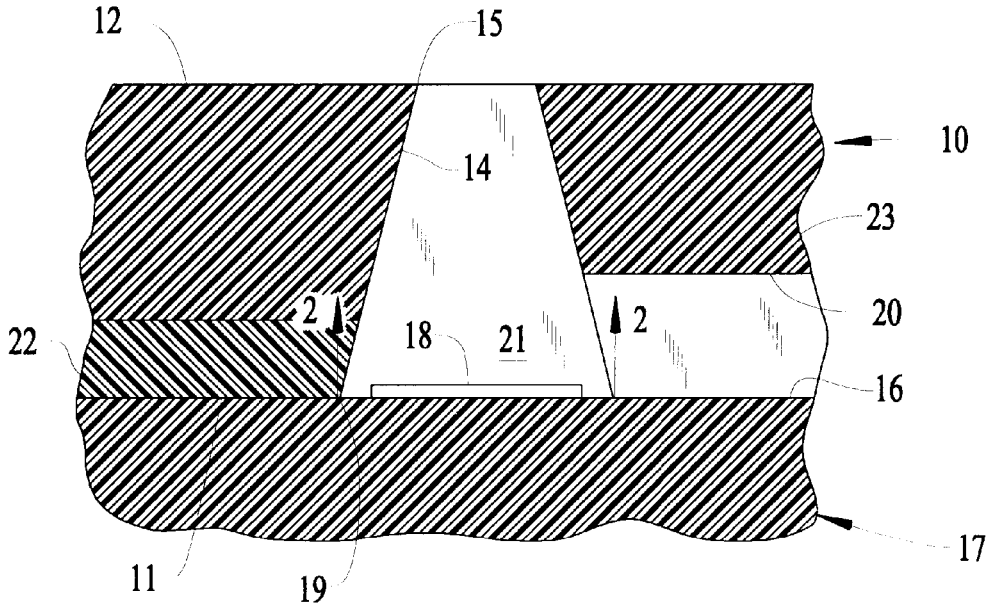
FIG. 1 is an enlarged cross sectional view of a portion of a nozzle plate of the present invention and taken along line 1—1 of FIG. 2.
Figure 2:
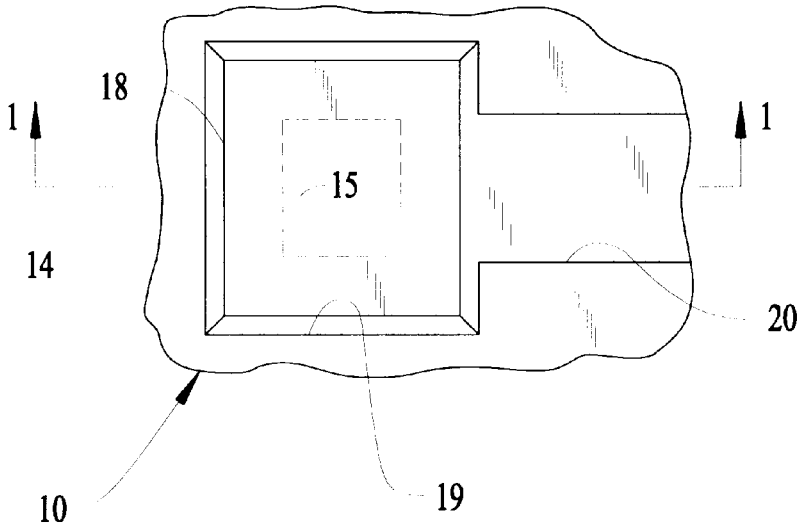
FIG. 2 is a fragmentary enlarged bottom plan view of the nozzle plate of FIG. 1 and taken along the line 2—2 of FIG. 1.

Referring to the drawings and particularly FIG. 1, there is shown a nozzle plate 10 for use in a print head of a thermal ink jet printer. The nozzle plate 10 includes a pair of substantially parallel surfaces 11 and 12 between which a plurality of passages (one shown) 14 extend. As shown in FIG. 2, the passage 14 has a rectangular shape and converges from the surface 11 (see FIG. 1) towards the surface 12 at which the passage 14 terminates in a rectangular shaped orifice 15 (see FIG. 2).

The nozzle plate 10 (see FIG. 1) is attached to a surface 16 of a semiconductor substrate 17. The surface 16 of the semiconductor substrate 17 has a plurality of thin film heat resistors 18 (one shown) supported thereby. The number of the passages 14 is equal to the number of the resistors 18 so that each of the resistors 18 is positioned within large end 19 of the passage 14. Each of the resistors 18 is encapsulated within several layers of heat conductive material (not shown).

As shown in FIG. 2, the large end 19 of the passage 14 has the same shape as the resistor 18 and is slightly larger. Thus, the large end 19 of the rectangular shaped passage 14 extending through the nozzle plate 10 has each of its walls spaced substantially the same distance from an adjoining surface of the resistor 18 and as near as possible.

The nozzle plate 10 has a plurality of ink supply channels 20 formed therein by extending inwardly from the surface 11 (see FIG. 1) of the nozzle plate 10. Thus, each of the channels 20 is closed by the surface 16 of the semiconductor substrate 17 when the nozzle plate 10 is adhered to the semiconductor substrate 17. The number of the ink supply channels 20 may be equal to or greater than the number of the passages 14 in the nozzle plate 10. That is, each of the passages 14 may be connected to more than one of the ink supply channels 20.

Each of the ink supply channels 20 is connected to an ink supply source in a manner similar to that shown in U.S. Pat. No. 6,158,843 to Murthy et al., which is incorporated by reference herein.

The portion of the passage 14 (see FIG. 1) from the surface 11 to the intersection of the base of the ink supply channel 20 is defined as a bubble or firing chamber 21.

The nozzle plate 10 is made from a polymeric material selected from the group consisting of polyimide polymers, polyester polymers, fluorocarbon polymers, and polycarbonate polymers. The nozzle plate 10 is preferably formed of a polyimide polymer.

The preferred polyimide polymer is a planar laminate having a thickness of 63.5 microns and sold by Rogers Corporation, Chandler, Ariz. as RFLEX R1100. This laminate has an adhesive layer or portion 22 of phenolic butyral adhesive and a layer or portion 23 of polyimide. The adhesive layer 22 extends from the surface 11 for 12.7 microns, and the layer 23 of polyimide polymer extends 50.8 microns to the surface 12.

The ink supply channel 20 extends from the surface 11 for about 22 microns so that the ink supply channel 20 is not only disposed in the entire thickness of the layer 22 of phenolic butyral adhesive but also in a portion of the layer 23 of polyimide. Thus, the phenolic butyral adhesive layer 22, which extends from the surface 11 towards the surface 12, is an adhesive for adhering the surface 11 of the nozzle plate 10 to the surface 16 of the semiconductor substrate 17.

The thickness of the laminate may vary from 15–100 microns and is preferably 25–75 microns. Depending on the thickness of the laminate, the ink supply channels 20 may extend from the surface 11 for a distance of 5–75 microns.

Each of the passages 14 extending through the thickness of the nozzle plate 10 may be formed in a continuous fashion by laser ablation in a single mask step. However, formation in the nozzle plate 10 of throat and entrance regions of the ink flow channels 20 and filter trap structures in the ink flow channels 20 may require a separate mask as is currently needed.

It should be understood that it is not necessary for the adhesive layer 22 to be integral with the polyimide layer 23. However, it is preferred that they be integral. Thus, if the adhesive layer 22 were not integral with the polyimide layer 23, then the adhesive layer 22 would have to be added in a separate step before the passage 14 is formed.

It should be understood that the laminate could be a single material if it had all of the desired properties of the layers 22 and 23. It also should be understood that the laminate could be formed of more than two layers if a third layer with a different property than the layers 22 and 23 is desired.

An advantage of this invention is that it significantly decreases air bubbles in the bubble or firing chamber relative to presently available polymeric nozzle plates.

For purposes of exemplification, a preferred embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. A nozzle plate for a thermal ink jet printer comprising:

a polymeric body having a pair of substantially parallel surfaces;

said body having a plurality of passages extending therethrough from one of said substantially parallel surfaces to the other of said substantially parallel surfaces;

each of said passages having a rectangular configuration continuously converging from said other surface to said one surface;

each of said passages defining a nozzle orifice at said one surface of said body;

said body having said other surface adapted to be attached to a semiconductor substrate having rectangular shaped resistors for disposition in each of said passages when attached to the semiconductor substrate;

said passage at said other surface being only slightly larger than the resistor disposed therein;

said body having a plurality of ink flow channels communicating at one end with an ink supply source;

and each of said ink flow channels communicating at its other end with one of said passages adjacent said other surface of said body, each of said passages having at least one of said ink flow channels communicating therewith.

2. The nozzle plate according to claim 1 in which said polymer body has:

a first portion including said one surface formed of a polymeric material selected from the group consisting of polyimide polymers, polyester polymers, fluorocarbon polymers, and polycarbonate polymers;

and a second portion including said other surface, said second portion having adhesive characteristics for adhering said other surface to the semiconductor substrate.

3. The nozzle plate according to claim 2 in which said first portion of said body is a polyimide polymer.

4. The nozzle plate according to claim 3 in which said second portion of said body is a phenolic butyral adhesive.

5. The nozzle plate according to claim 4 in which said ink flow channels extend from said other surface of said body through the entire thickness of said second portion of said body and part of the thickness of said first portion of said body.

6. The nozzle plate according to claim 3 in which said ink flow channels extend from said other surface of said body through the entire thickness of said second portion of said body and part of the thickness of said first portion of said body.

7. The nozzle plate according to claim 2 in which said second portion of said body is a phenolic butyral adhesive.

8. The nozzle plate according to claim 7 in which said ink flow channels extend from said other surface of said body through the entire thickness of said second portion of said body and part of the thickness of said first portion of said body.

9. The nozzle plate according to claim 2 in which said ink flow channels extend from said other surface of said body through the entire thickness of said second portion of said body and part of the thickness of said first portion of said body.

10. An ink jet print head including:

a semiconductor substrate including:

a support surface;

and a plurality of resistors supported by said support surface;

a polymeric nozzle plate;

said nozzle plate having a pair of substantially parallel surfaces;

said nozzle plate having a plurality of passages extending therethrough from one of said substantially parallel surfaces to the other of said substantially parallel surfaces;

each of said passages having a rectangular configuration continuously converging from said other surface to said one surface;

each of said passages defining a nozzle orifice at said one surface of said nozzle plate;

said other surface of said nozzle plate being attached to said support surface of said semiconductor substrate so that each of said resistors is disposed in one of said passages in said nozzle plate;

said nozzle plate having a plurality of ink flow channels communicating at one end with an ink supply source;

and each of said ink flow channels communicating at its other end with one of said passages adjacent said other surface of said nozzle plate, each of said passages having at least one of said ink flow channels communicating therewith.

11. The ink jet print head according to claim 10 in which said polymer nozzle plate has:

a first portion including said one surface and formed of a polymeric material selected from the group consisting of polyimide polymers, polyester polymers, fluorocarbon polymers, and polycarbonate polymers;

and a second portion including said other surface and thinner than said first portion, said second portion having adhesive characteristics for adhering said other surface to said support surface of said semiconductor substrate.

12. The ink jet print head according to claim 11 in which said first portion of said nozzle plate is a polyimide polymer.

13. The ink jet print head according to claim 12 in which said second portion of said nozzle plate is a phenolic butyral adhesive.

14. The ink jet print head according to claim 13 in which said ink flow channels extend from said other surface of said nozzle plate through the entire thickness of said second portion of said nozzle plate and part of the thickness of said first portion of said nozzle plate.

15. The ink jet print head according to claim 12 in which said ink flow channels extend from said other surface of said nozzle plate through the entire thickness of said second portion of said nozzle plate and part of the thickness of said first portion of said nozzle plate.

16. The ink jet print head according to claim 11 in which said second portion of said nozzle plate is a phenolic butyral adhesive.

17. The ink jet print head according to claim 16 in which said ink flow channels extend from said other surface of said nozzle plate through the entire thickness of said second portion of said nozzle plate and part of the thickness of said first portion of said nozzle plate.

18. The ink jet print head according to claim 11 in in which said ink flow channels extend from said other surface of said nozzle plate through the entire thickness of said second portion of said nozzle plate and part of the thickness of said first portion of said nozzle plate.

* * * * *